US006618488B2

(12) United States Patent
Nakamura

(10) Patent No.: US 6,618,488 B2
(45) Date of Patent: Sep. 9, 2003

(54) SPEAKER SYSTEM

(75) Inventor: Takeshi Nakamura, Uji (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/749,975

(22) Filed: Dec. 28, 2000

(65) Prior Publication Data

US 2001/0005422 A1 Jun. 28, 2001

(30) Foreign Application Priority Data

Dec. 28, 1999 (JP) ..... 11-374380

(51) Int. Cl.[7] ..... H04R 1/28
(52) U.S. Cl. ..... 381/349; 181/199
(58) Field of Search ..... 381/304, 305, 381/338, 349, FOR 146, FOR 141, 345, 351, 386, 346, 348; 181/198, 199

(56) References Cited

U.S. PATENT DOCUMENTS 4,348,552 A * 9/1982 Siccone ..... 381/99
4,837,826 A * 6/1989 Schupbach ..... 381/308
6,144,751 A * 11/2000 Velandia ..... 381/345

* cited by examiner

*Primary Examiner*—Curtis Kuntz
*Assistant Examiner*—Brian Ensey
(74) *Attorney, Agent, or Firm*—Keating & Bennett, LLP

(57) ABSTRACT

A speaker system includes a speaker box and a speaker mounted thereon. A bass reflex duct is provided in the speaker box at a position corresponding to an approximate center portion of the speaker. In addition, another duct is provided around the speaker in the speaker box. The bass reflex duct is arranged inside of a duct so that the bass reflex duct and the duct overlap each other. The speaker system is arranged to efficiently direct the back pressure of a speaker to the bass reflex duct and greatly increases the sound pressure in resonance even when a compact speaker box is used.

20 Claims, 6 Drawing Sheets

SPEAKER SYSTEM

BACKGROUND OF THE INVENTION

1. Field of the Invention

The present invention relates to a speaker system, and more specifically, relates to a speaker system having a bass reflex duct to amplify a bass range.

2. Description of the Related Art

In some speaker systems having a speaker mounted in a speaker box, a bass reflex duct is located at a rear of the speaker inside of the speaker box. The bass reflex duct leads to a bass reflex port opened in the speaker box. In this speaker system, the resonance frequency is determined by the interior volume of the speaker box, and by the diameter and the length of the bass reflex duct according to the Helmholtz resonance phenomenon. Therefore, in order to amplify the bass range, the sound of the desired frequency can be amplified by regulating the dimensions and arrangement of the speaker box and the bass reflex duct.

The resonance frequency can thus be determined by making use of the Helmholtz resonance phenomenon. However, to increase the sound pressure in the resonance, it is necessary to increase the diameter of the bass reflex duct and further to increase the length of the bass reflex duct to reduce the air resistance. However, if the diameter of the bass reflex duct is increased and the length of the bass reflex duct is increased, the size of the speaker box itself is increased. There is a method in which a plurality of bass reflex ducts are provided so as to decrease the diameter of the bass reflex duct and the length of the bass reflex duct, but the structure of the speaker box becomes complicated, and the speaker box cannot be reduced in size. When a compact speaker box is used, only a short bass reflex duct is possible. However, in this case, the diameter of the bass reflex port is of course decreased, and an increase in the sound pressure in the resonance cannot be expected.

SUMMARY OF THE INVENTION

In order to overcome the problems described above, preferred embodiments of the present invention provide a speaker system that efficiently directs the back pressure of the speaker to the bass reflex duct to greatly increase the sound pressure in the resonance while greatly miniaturizing the dimensions of the speaker box.

According to one preferred embodiment of the present invention, a speaker system includes a speaker box, a speaker mounted on the speaker box, a bass reflex duct located at a rear of the speaker of the speaker box, and an additional duct that is larger than the bass reflex duct and is disposed around the speaker inside the speaker box, wherein the bass reflex duct is arranged inside the additional duct, and the bass reflex duct and the additional duct overlap each other.

In such a speaker system, the additional duct preferably has a substantially cylindrical shape.

Since the bass reflex duct and the additional duct overlap each other, directionality is provided to the air flowing from the rear of the speaker into the speaker box and the back pressure of the speaker is easily and accurately directed to the bass reflex duct. Most of the back pressure of the speaker is directed and transmitted to the bass reflex duct, and the sound pressure at the resonance frequency is thereby greatly increased.

In particular, due to the substantially cylindrical shape of the additional duct, the air resistance is substantially equal in all directions around the speaker when the back pressure of the speaker propagates inside the speaker box, the leakage of the back pressure is minimized, and most of the back pressure is directed to the bass reflex duct.

In accordance with various preferred embodiments of the present invention, the back pressure of the speaker is accurately and efficiently directed to the bass reflex duct, and the bass range is greatly amplified irrespective of the size and the shape of the speaker box.

Further features, elements, characteristics and advantages of the present invention will be apparent from the detailed description of preferred embodiments with reference to the attached drawings.

DETAILED DESCRIPTION OF PREFERRED EMBODIMENTS

Figure 1:
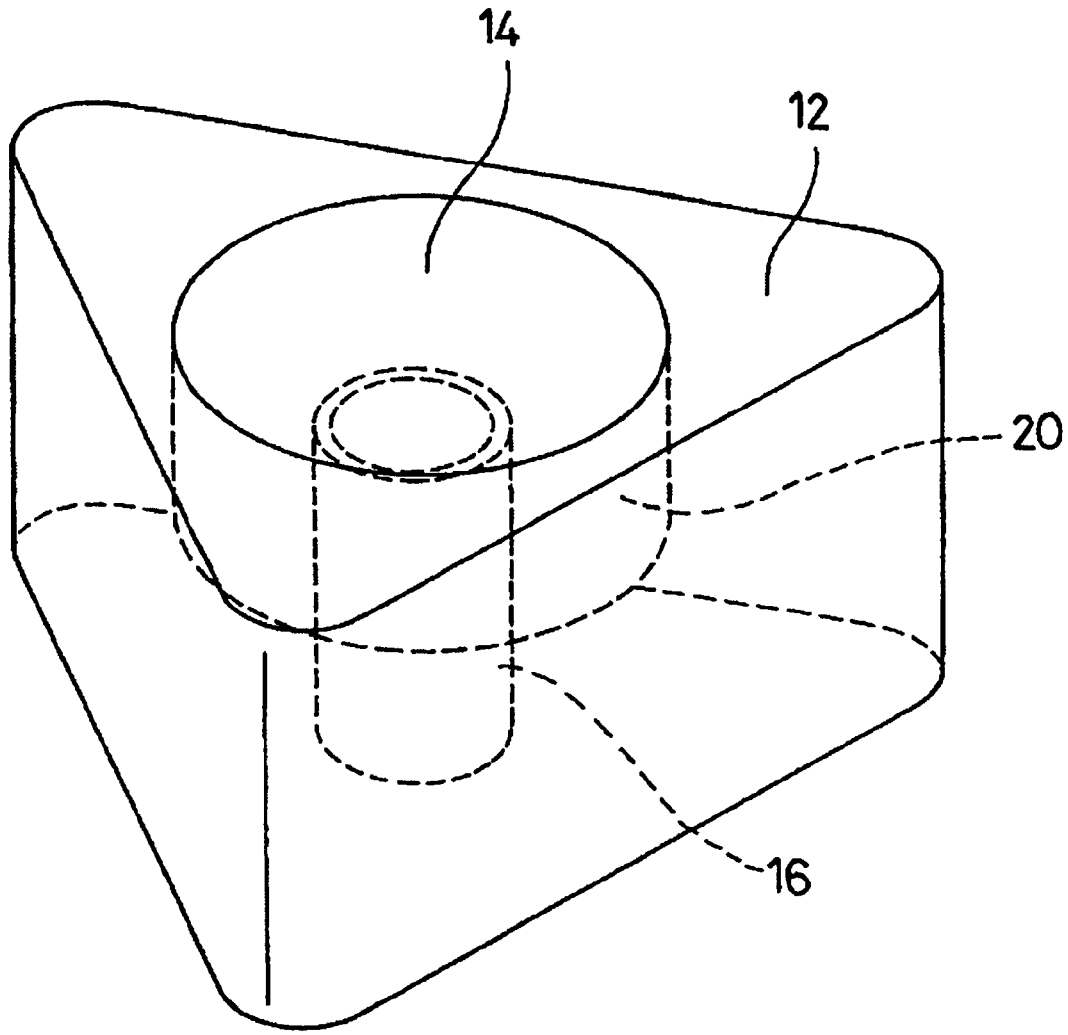
FIG. 1 is a perspective view of an example of a speaker system according to a first preferred embodiment of the present invention.
Figure 2:
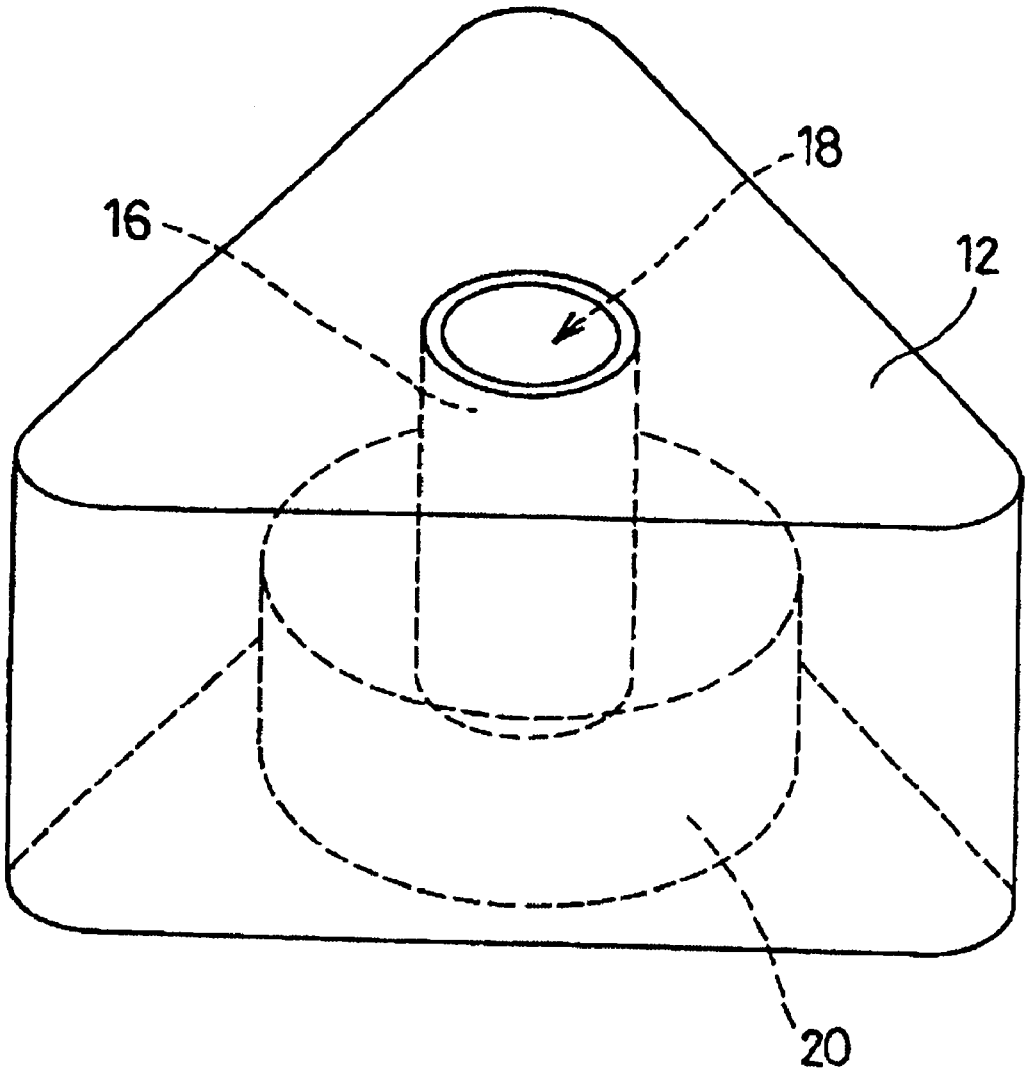
FIG. 2 is a perspective view of the speaker system in FIG. 1 viewed from the opposite side.

FIG. 1 is a perspective view showing a preferred embodiment of a speaker system of the present invention, and FIG. 2 is a perspective view of this preferred embodiment viewed from the opposite side. A speaker system 10 according to this preferred embodiment is compact and includes, for example, a substantially equilaterally triangular prismatic speaker box 12. A speaker 14 is mounted at one substantially triangular surface of the speaker box 12. The speaker 14 is, for example, a piezoelectric type, a dynamic type, or, an electrostatic capacitor type.

Figure 3:
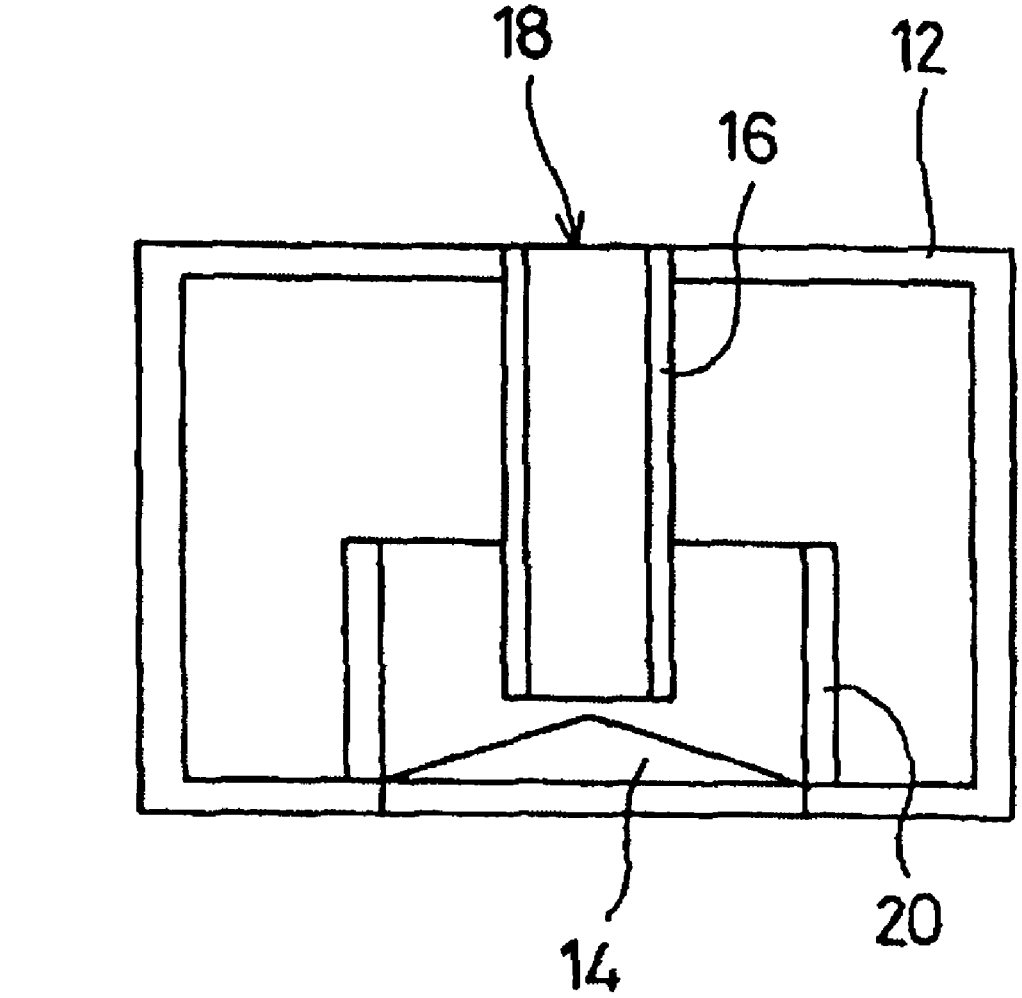
FIG. 3 is a schematic cross-sectional view of the inside of the speaker system in FIG. 1.

A substantially cylindrical bass reflex duct 16, for example, is disposed at a rear surface of the speaker 14. The bass reflex duct 16 is arranged at a position corresponding to an approximate center portion of the rear surface of the speaker 14 but spaced from the speaker 14 and arranged to lead to a bass reflex port 18 penetrating the other substantially triangular surface of the speaker box 12. In addition, an additional substantially cylindrical duct 20 is disposed around the speaker 14 inside of the speaker box 12. As illustrated in FIG. 3, the diameter of the duct 20 is preferably larger than the diameter of the bass reflex duct 16. The bass reflex duct 16 is disposed inside of the duct 20. The bass reflex duct 16 and the duct 20 overlap each other.

In this speaker system 10, sound is reproduced by the speaker 14. The bass range is amplified by the bass reflex duct 16 and the bass reflex port 18. The frequency in the sound frequency range to be amplified is the resonance frequency determined by the interior volume of the speaker box 12, the length of the bass reflex duct 16, and the diameter of the bass reflex duct 16.

Figure 4:
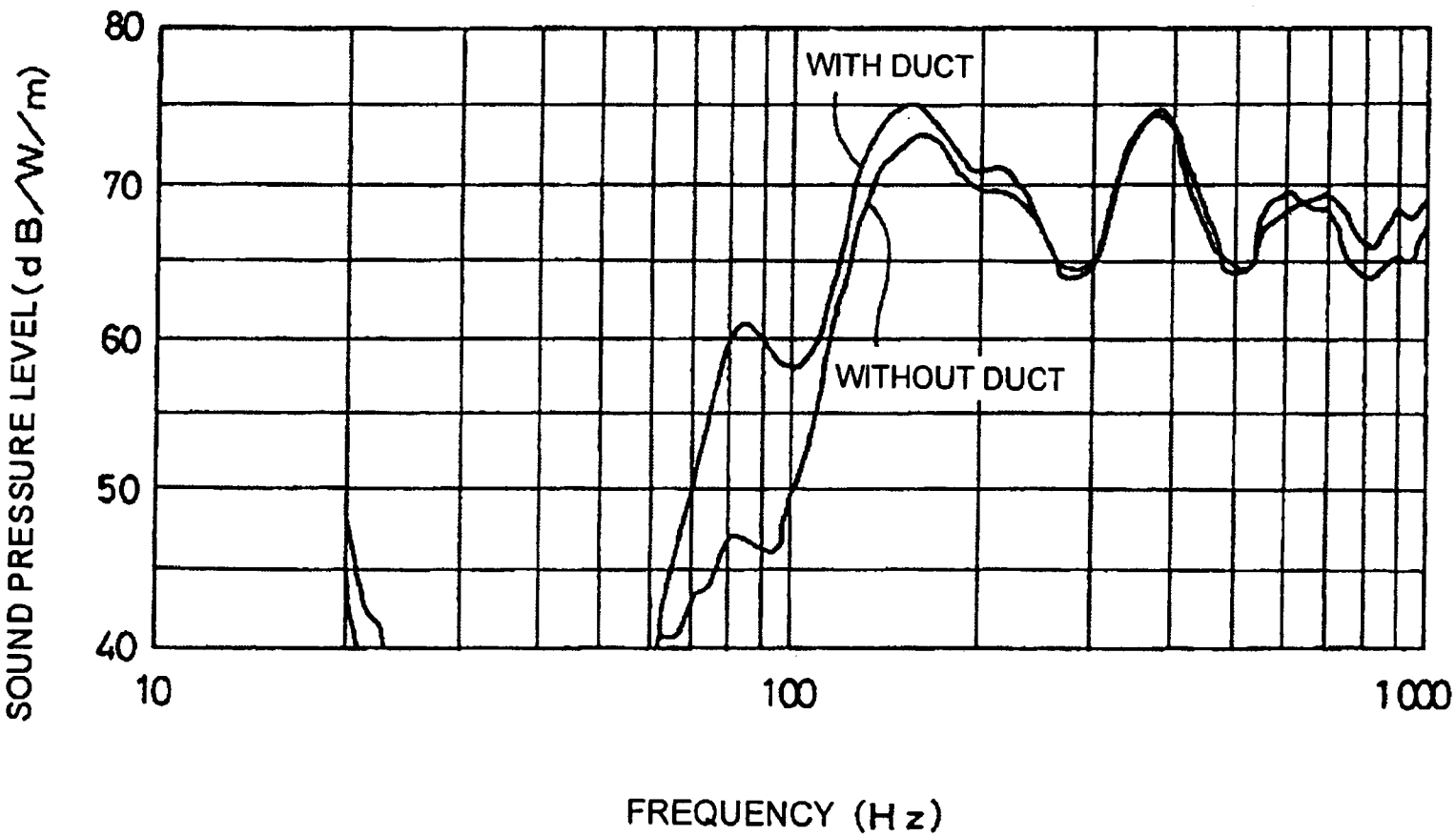
FIG. 4 is a graph showing the relationship between the case where a duct overlapping the bass reflex duct is provided and the case in which no duct is provided.

The relationship between the frequency and the sound pressure level was measured and is shown in FIG. 4 for the speaker system shown in FIGS. 1 to 3, and for a speaker system having no duct 20, as experimental examples. FIG. 4 shows that the sound pressure level in the sound frequency range of about 60 Hz to about 100 Hz is in both respective speaker systems. This shows that resonance occurs at a resonance frequency determined by the speaker box 12, the bass reflex duct 16, etc. Comparison of these speaker systems shows that the sound pressure level at the resonance frequency is substantially higher in the speaker system 10 having the duct 20.

It is concluded from this experiment that, in the speaker system 10 having the duct 20, the back pressure of the speaker 14 is efficiently led to the bass reflex duct 16. However, in the speaker system having no duct 20, the back pressure of the speaker 14 is diffused in the speaker box 12 and is difficult to lead to the bass reflex duct 16. This means that since the bass reflex duct 16 and the duct 20 overlap each other, the back pressure of the speaker 14 is difficult to diffuse when the back pressure is directed into the speaker box 12 from the speaker 14, and the back pressure is led to the bass reflex duct 16.

Since the resonance frequency is mainly determined by the interior volume of the speaker box 12 and the size of the bass reflex duct 16, a clearance is necessary between the bass reflex duct 16 and the duct 20, and between the duct 20 and an inner surface of the speaker box 12. This is because the interior volume relating to the resonance is the volume of a space to be defined by the bass reflex duct 16 and the duct 20 if there is no clearance therebetween, and the desired resonance frequency cannot be obtained.

Such a structure is particularly effective for the compact speaker system 10. This means that the short bass reflex duct 16 is preferably adopted in the compact speaker system 10, and the diameter of the bass reflex duct 16 is also decreased in accordance therewith. Also, in this speaker system 10, the back pressure of the speaker 14 is easily and efficiently led to the bass reflex duct 16 by the duct 20.

Figure 5:
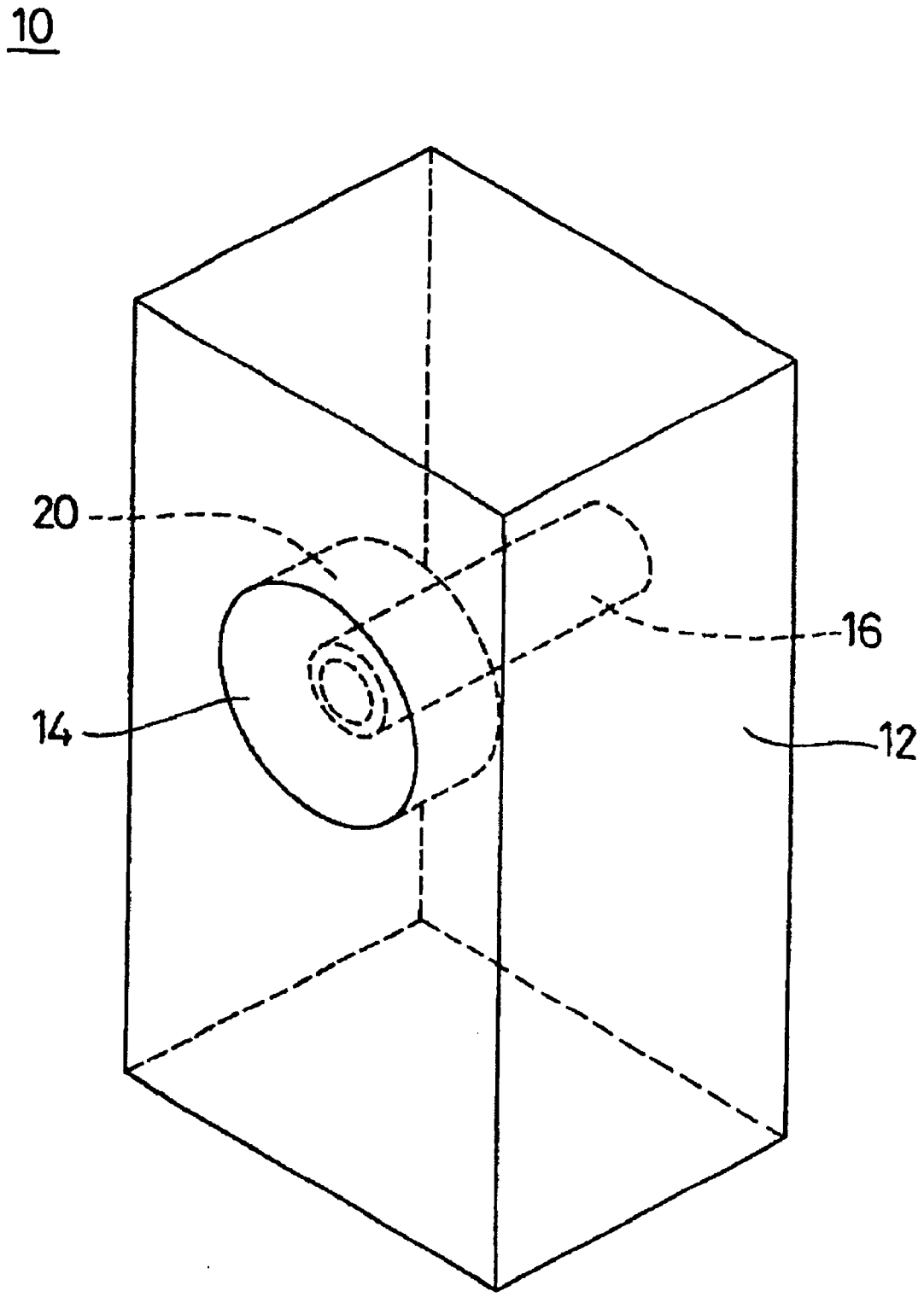
FIG. 5 is a schematic cross-sectional view of another example of the speaker system according to a second preferred embodiment of the present invention.

The substantially equilaterally triangular prismatic speaker box 12 is included in the speaker system 10 shown in FIG. 1, and, of course, the sound pressure in the bass range is greatly amplified by providing the bass reflex duct 16 and another duct 20 also in a speaker system using the substantially rectangular prismatic speaker box 12 as illustrated in FIG. 5. Shapes other than the equilaterally prismatic or quadratic prismatic shape may be adopted as the shape of the speaker box 12.

Figure 6:
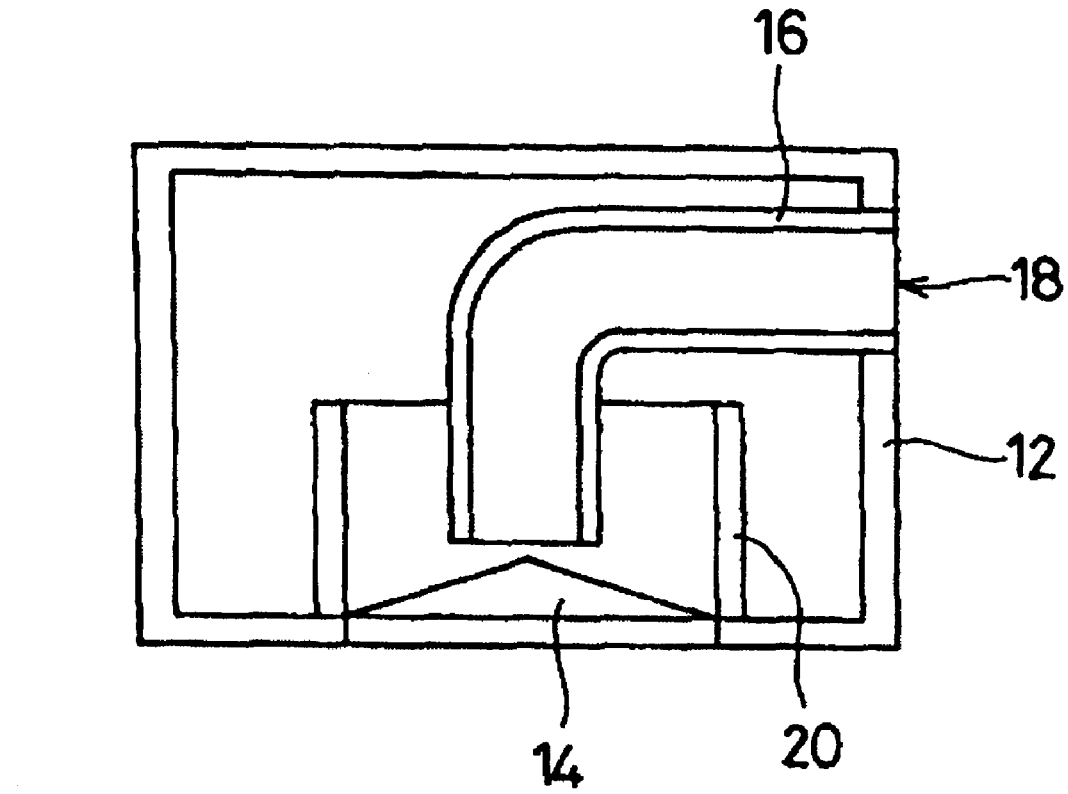
FIG. 6 is a schematic cross-sectional view of another speaker system according to a third preferred embodiment of the present invention.

The bass reflex duct 16 may be substantially straight, and substantially curved as shown in FIG. 6, or may have another suitable arrangement. Even when such a bass reflex duct 16 is adopted, the sound pressure in the bass range can be amplified by overlapping the bass reflex duct 16 and the duct 20 with each other. Thus, the bass reflex port 18 may be provided at the back or at the side of the speaker 14, or at the surface on which the speaker 14 is provided.

The most preferable position of the bass reflex duct 16 is the position corresponding to an approximate center portion of the speaker 14, but the advantages of the present invention can be obtained as long as the bass reflex duct is disposed inside of the duct 20. The duct 20 may be substantially cylindrical and may also have a polygonal prismatic shape or other suitable shape. This means that the advantages of the present invention can be obtained if the air resistance from the speaker 14 to its periphery increases. However, in a duct having a polygonal prismatic shape, the difference in air resistance cannot be avoided due to the difference in distance from the speaker 14 to the duct 20. Thus, the substantially cylindrical shape is most preferable for the duct 20.

While the invention has been described with reference to preferred embodiments thereof, many modifications and variations of the present invention are possible in light of the above teachings. It is therefore to be understood that within the scope of the appended claims, the invention may be practiced otherwise than as specifically described.

What is claimed is:

1. A speaker system comprising:

a speaker box;

a speaker mounted on said speaker box;

a bass reflex duct disposed at a rear portion of said speaker in said speaker box; and an additional duct that is independent and separate from said bass reflex duct and that is larger than said bass reflex duct and is disposed around said speaker inside of said speaker box; wherein said bass reflex duct is arranged inside of said additional duct, and said bass reflex duct and said additional duct overlap each other; and a clearance is provided between the additional duct and the speaker box.

2. A speaker system according to claim 1, wherein said additional duct has a substantially cylindrical shape.

3. A speaker system according to claim 1, wherein said speaker box has a substantially equilaterally triangular prismatic configuration.

4. A speaker system according to claim 1, wherein the speaker is one of a piezoelectric type, a dynamic type, and an electrostatic capacitor type.

5. A speaker system according to claim 1, wherein said bass reflex duct has a substantially cylindrical shape.

6. A speaker system according to claim 1, wherein said bass reflex duct is disposed at an approximate center portion of the rear surface of said speaker.

7. A speaker system according to claim 1, wherein said bass reflex duct is spaced from said speaker.

8. A speaker system according to claim 1, further comprising a bass reflex port arranged to penetrate a surface of the speaker box, wherein said bass reflex duct is arranged to lead to the bass reflex port.

9. A speaker system according to claim 1, wherein the bass reflex duct and the additional duct are arranged to direct the back pressure from the speaker to the bass reflect duct.

10. A speaker system according to claim 1, wherein a clearance is provided between the bass reflex duct and the additional duct.

11. A speaker system according to claim 1, wherein the bass reflex duct has one of a substantially straight configuration and a substantially curved configuration.

12. A speaker system comprising:

a speaker box;

a speaker mounted on said speaker box;

a bass reflex duct disposed at a rear portion of said speaker in said speaker box and spaced from said speaker; and a substantially cylindrical additional duct that is independent and separate form said bass reflex duct and is disposed around said speaker inside of said speaker box; wherein said bass reflex duct is arranged inside of said additional duct, said bass reflex duct and said addition duct overlap each other, and said bass reflex duct and said additional duct are arranged to direct the back pressure from the speaker to the bass reflect duct; and a clearance is provided between the additional duct and the speaker box.

13. A speaker system according to claim 12, wherein said additional duct has a diameter that is larger than that of said bass reflex duct.

14. A speaker system according to claim 12, wherein said speaker box has a substantially equilaterally triangular prismatic configuration.

15. A speaker system according to claim 12, wherein the speaker is one of a piezoelectric type, a dynamic type, and an electrostatic capacitor type.

16. A speaker system according to claim 12, wherein said bass reflex duct has a substantially cylindrical shape.

17. A speaker system according to claim 12, wherein said bass reflex duct is disposed at an approximate center portion of the rear surface of said speaker.

18. A speaker system according to claim 12, further comprising a bass reflex port arranged to penetrate a surface of the speaker box, wherein said bass reflex duct is arranged to lead to the bass reflex port.

19. A speaker system according to claim 12, wherein a clearance is provided between the bass reflex duct and the additional duct.

20. A speaker system according to claim 12, wherein the bass reflex duct has one of a substantially straight configuration and a substantially curved configuration.

* * * * *